US006578664B1

(12) United States Patent
Doherty

(10) Patent No.: US 6,578,664 B1
(45) Date of Patent: Jun. 17, 2003

(54) WINDOW GUARD WITH QUICK RELEASE LATCHING SYSTEM

(76) Inventor: Stuart Doherty, 115 N. Vermont, Royal Oak, MI (US) 48067

( * ) Notice: Subject to any disclaimer, the term of this patent is extended or adjusted under 35 U.S.C. 154(b) by 0 days.

(21) Appl. No.: 09/721,292

(22) Filed: Nov. 22, 2000

(51) Int. Cl.[7] ..... E04G 3/00

(52) U.S. Cl. ..... 182/93; 182/70; 182/77; 182/197; 49/141

(58) Field of Search ..... 182/70, 74, 75, 182/76, 77, 73, 95, 84, 196, 197, 199, 163; 292/221, 226, 304, DIG. 55, DIG. 72; 49/56, 57, 141, 395

(56) References Cited

U.S. PATENT DOCUMENTS 3,259,207 A * 7/1966 Schoeffler ..... 182/77 X
3,363,722 A * 1/1968 Rimi ..... 182/95
3,408,959 A * 11/1968 Cripe et al. ..... 182/77
3,847,246 A * 11/1974 Banner ..... 182/78
4,050,725 A * 9/1977 Wilson et al. ..... 292/304
4,111,477 A * 9/1978 Rigali ..... 292/252
4,127,966 A * 12/1978 Schmidt ..... 49/141
4,401,183 A * 8/1983 Schler ..... 182/8
4,634,157 A * 1/1987 Fernandez ..... 292/218
4,757,876 A * 7/1988 Peacock ..... 182/95
4,759,539 A * 7/1988 Nieppola ..... 182/95 X
4,796,384 A * 1/1989 Warwick ..... 49/55
4,815,561 A * 3/1989 Ostrander ..... 182/21
4,856,229 A * 8/1989 Tserng ..... 49/56
5,018,302 A * 5/1991 Kluge ..... 49/56
5,022,491 A * 6/1991 Gill ..... 182/95
5,022,690 A * 6/1991 Coltrin et al. ..... 292/21
5,103,934 A * 4/1992 Brooks ..... 182/77 X
5,174,411 A * 12/1992 Oliver et al. ..... 182/77
5,289,655 A * 3/1994 Marmora et al. ..... 49/141
5,584,514 A * 12/1996 Mascotte ..... 292/57
5,683,123 A * 11/1997 Ruoss ..... 292/57
5,893,431 A * 4/1999 Cranswick et al. ..... 182/70

* cited by examiner

*Primary Examiner*—Bruce A. Lev
(74) *Attorney, Agent, or Firm*—John R. Benefiel

(57) ABSTRACT

A quick release latched security window guard having a framework attached to a building exterior overlying a window is held with a cam latch system including a cam rod extending through the building wall, with an end protruding into a hollow member forming a part of the framework. A sliding latching sleeve is spring urged into a slot in the cam rod end to lock the framework in place. Rotation of a handle on the rod end within the building forces the sleeve back to be cammed out of the slot to release the framework. One or more fixed slotted latching posts may also be mounted to protrude into the hollow member and to be engaged by portions of the sleeve to form additional latching points, all of which are released by the rotation of a single cam rod. The framework may take the form of one or more ladder sections deployed to hang down from the window when the framework is pushed out after being released by the operation of the cam rod.

12 Claims, 20 Drawing Sheets

WINDOW GUARD WITH QUICK RELEASE LATCHING SYSTEM

BACKGROUND OF THE INVENTION

This invention concerns window guards for preventing entry into a building through the window.

Such guards are in widespread use and typically consist of a welded frame work of steel bars securely fastened over the outside of the window opening. While effective against intruders, these structures create a potential hazard as they prevent a quick exit through the window in fire emergencies.

Latching mechanisms have been devised to allow quick release of the window guard, as for example the mechanism shown in U.S. Pat. No. 4,634,157, where a single latch is operable by a door knob located on the inside wall next to the window to release a locking engagement to a pin fixed within a hollow member of the window guard framework.

A single latching point renders the structure vulnerable to being overcome with a pry bar. Multiple latches would be slow to release in an emergency. The cam mechanism shown would make it difficult to install the guard framework as it requires manipulation of the door knob by someone inside as another person positions the window guard framework over the window from the outside. Careful alignment of the mating parts is also necessary.

It is the object of the present invention to provide a window guard with a quick release latching system able to release latching at multiple points by operation of a single operator handle.

It is another object to provide such a window guard which allows easy installation of the window guard framework from the outside of the building without requiring help from a person on the inside.

SUMMARY OF THE INVENTION

These and other objects of the invention which will become apparent upon a reading of the follow specification and claims are achieved by a latching mechanism comprised of an elongated latching member slidable within a hollow shield member forming a portion of the window guard framework. The latching member is spring loaded to be urged towards a rotatable elongated cam rod extending through the building wall and into the hollow member. The cam rod has a slot in one end which is aligned with an edge at one end of the slidable latching member, and is engagable with the edge to thereby latch the window guard framework by engagement with the latching member.

The cam rod is restrained against axial movement by spaced collars on either end, but may be rotated with a handle on the inside of the building to cam the locking member opening edge wall out of the slot in the cam rod, releasing the framework to allow it to be pushed away from the window.

One or more fixed latching posts spaced from the cam rod each have a slot arranged to be engaged or disengaged with the locking member simultaneously with the engagement/disengagement of the latching member edge with the cam rod by sliding movement of the latching member so that the framework can be latched at multiple locations defined by the fixed pins and cam rod, all locations released by rotation of the single cam rod.

DETAILED DESCRIPTION

In the following detailed description, certain specific terminology will be employed for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Figure 1:
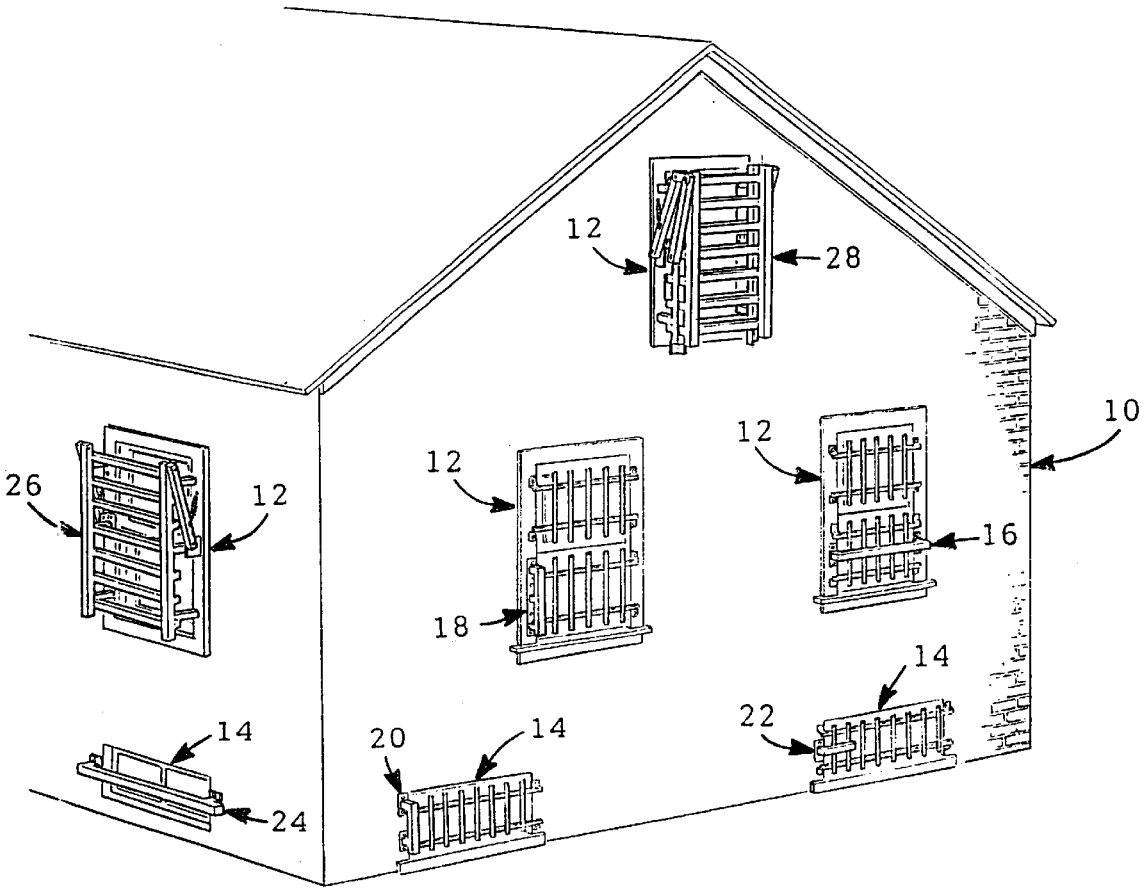
FIG. 1 is a perspective view of a building showing various forms of window guards according to the invention installed thereon.

FIG. 1 shows a building 10 having a member of windows 12, 14 of different sizes and at different levels of the building 10.

Several embodiments of window guards 16, 18, 20, 22, 24, 26 and 28 according to the present invention are shown installed over the various window openings 12, 14.

Figure 3:
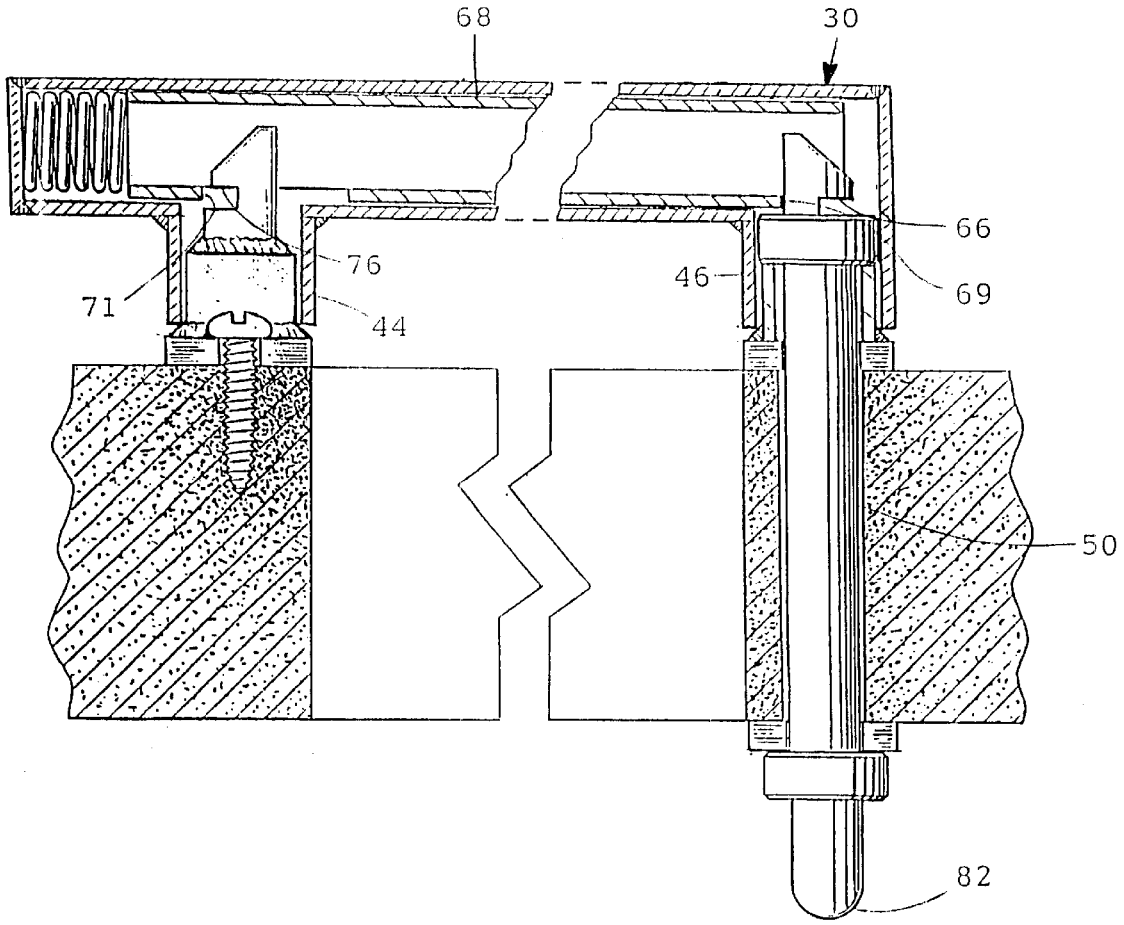
FIG. 3 is a partially sectional view of the window guard portion shown in FIG. 2 in the unlocked condition.
Figure 4:
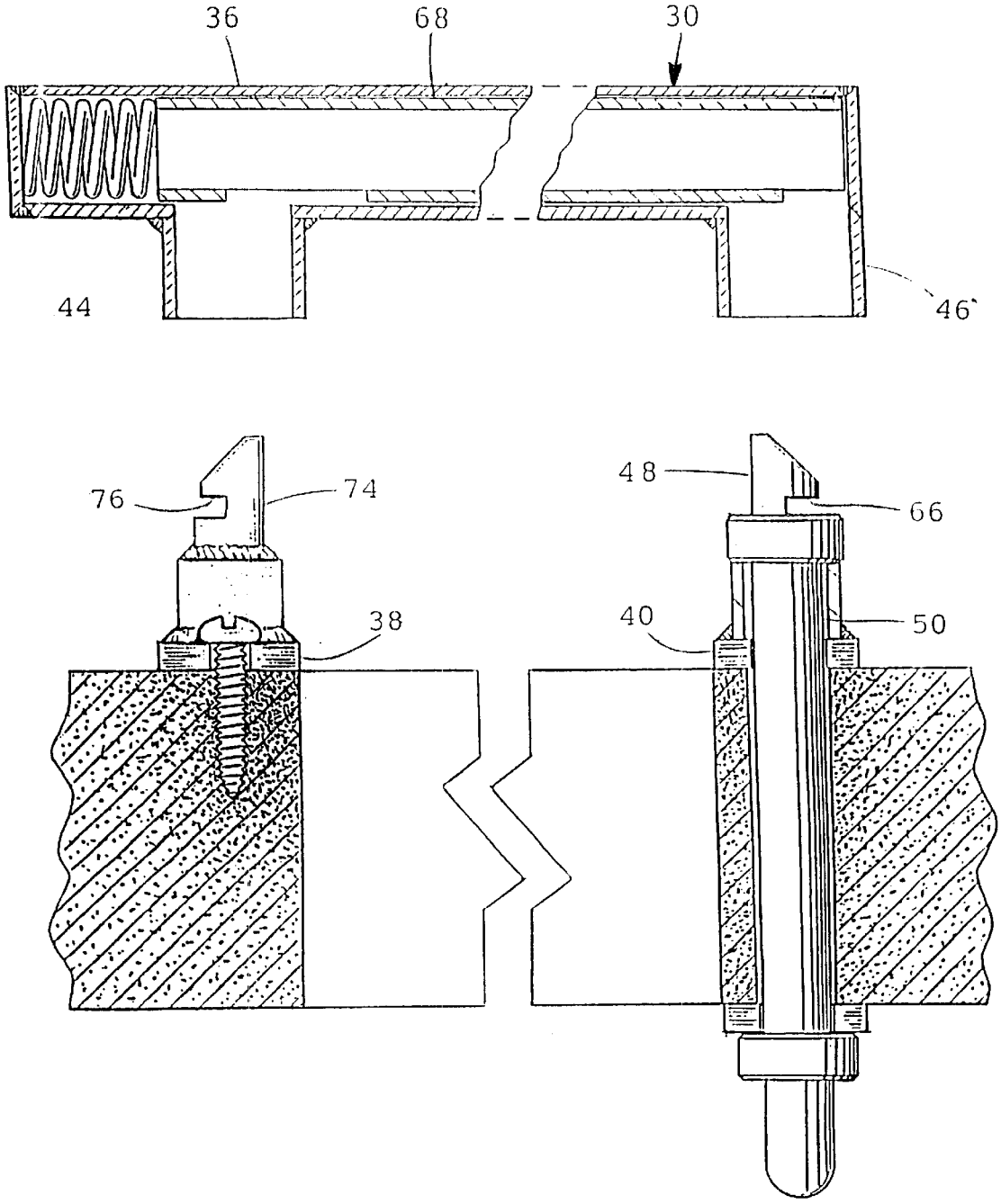
FIG. 4 is a partially sectional view of the window guard portion shown in FIG. 2 with the window guard portion separated from the mating latching system components.
Figure 4A:
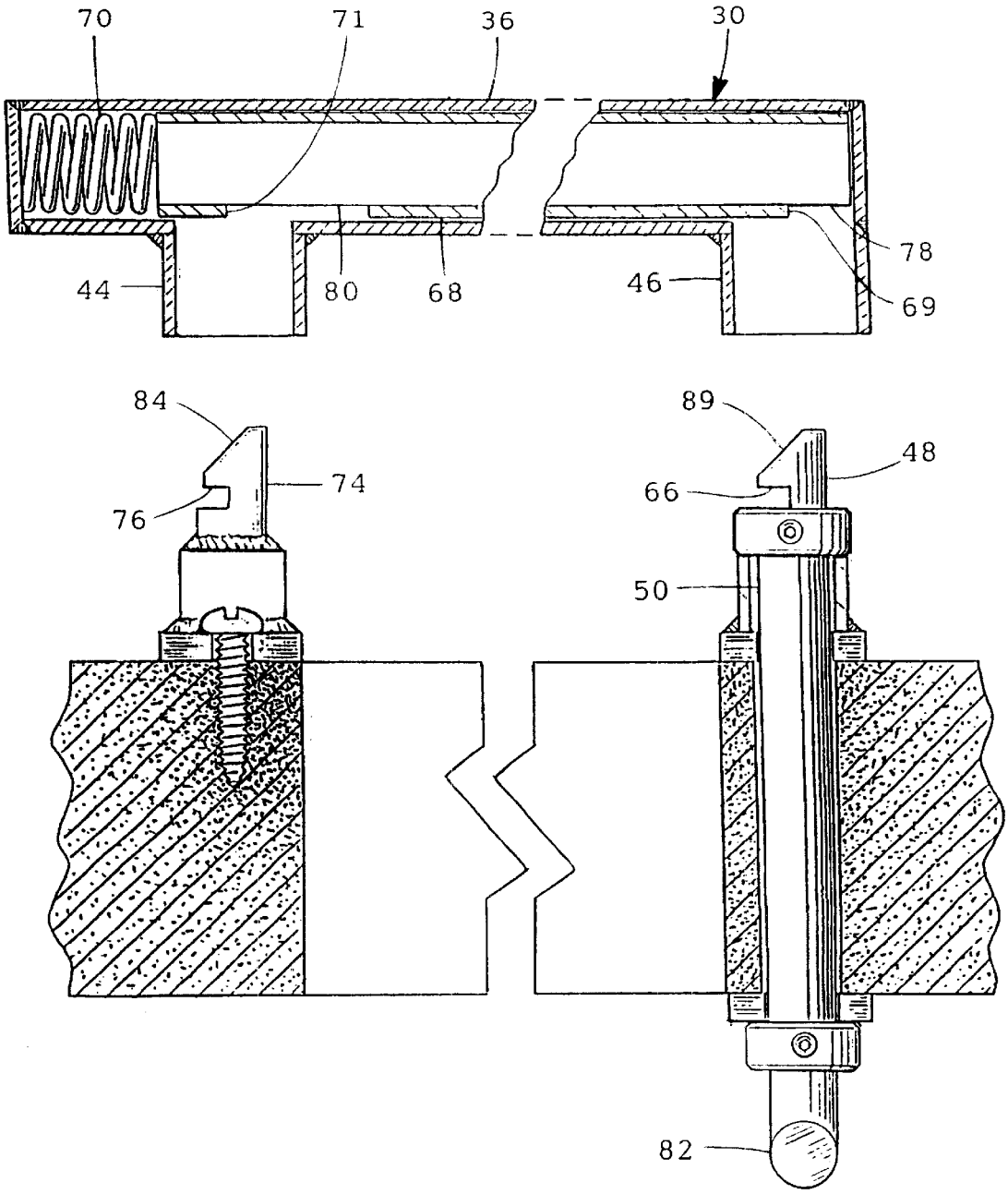
FIG. 4A is the same view as FIG. 4 but with the cam rod moved to a cocked position ready to receive the window guard for installation thereof.
Figure 5:
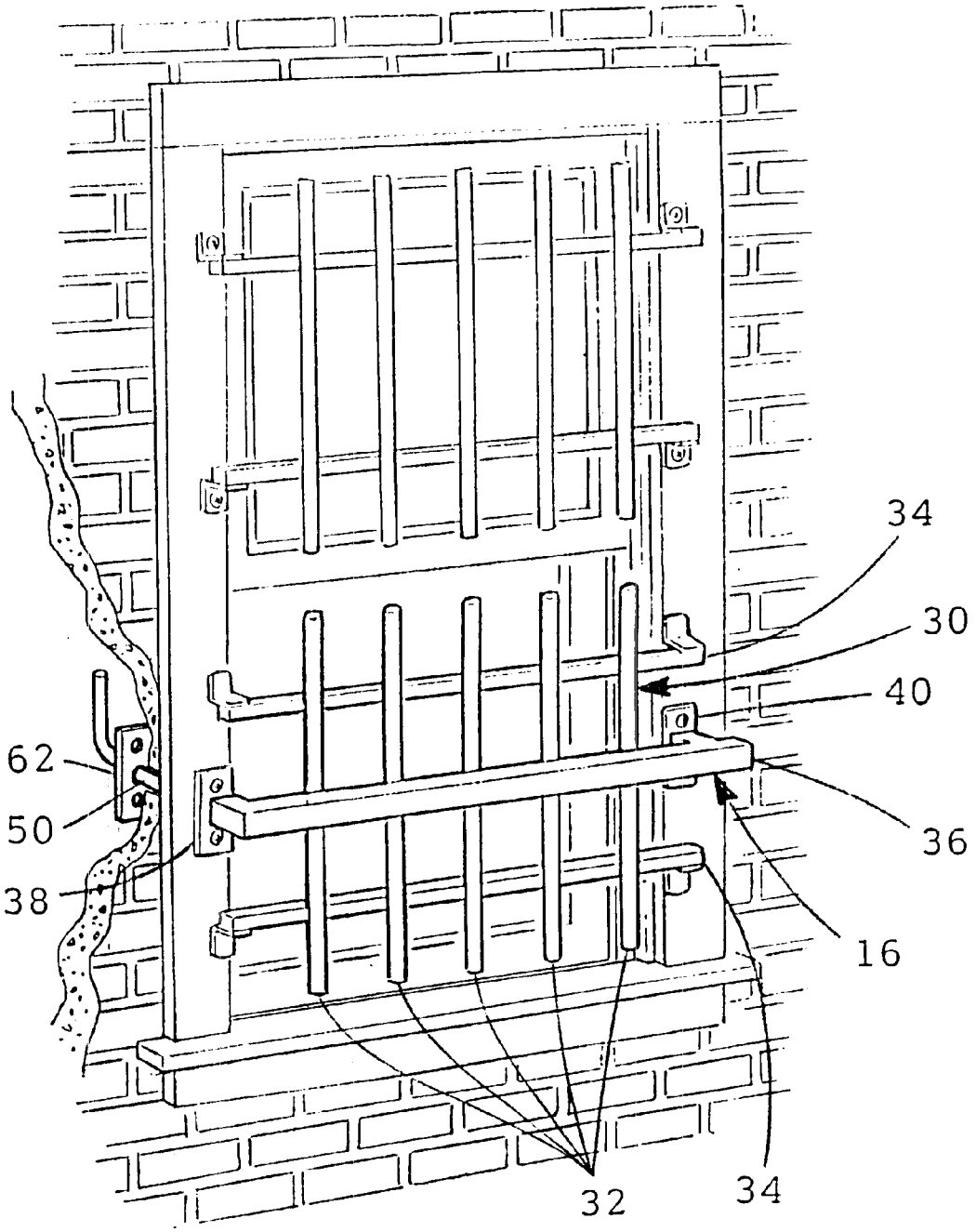
FIG. 5 is a fragmentary perspective external view of a window guard installation using the double latch system shown in FIGS. 2–4A.
Figure 6:
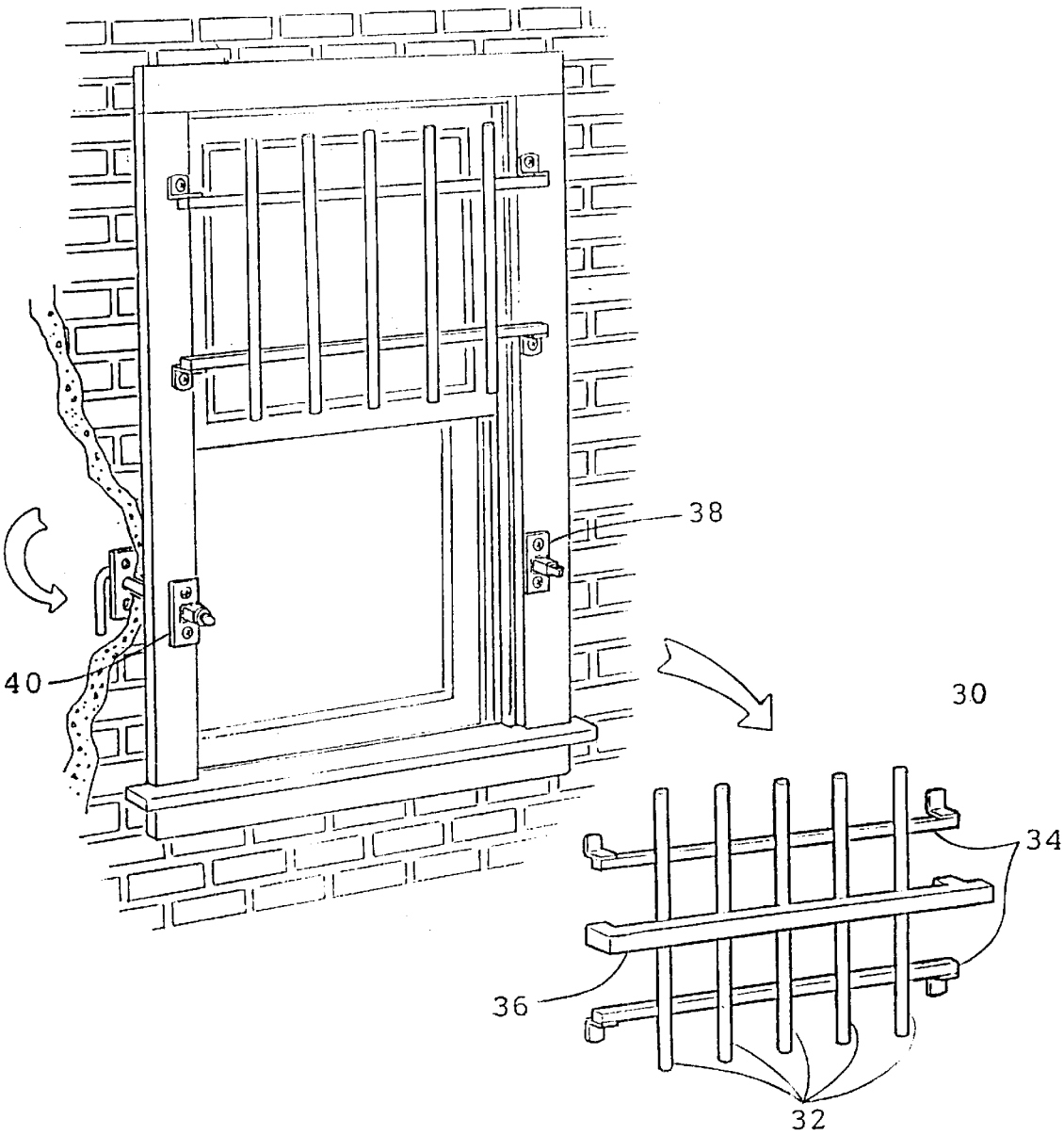
FIG. 6 is an external perspective view of the window guard installation shown in FIG. 5 unlatched and pushed off.

FIGS. 2–4A show the details of the window guard embodiment 16, which embodiment is also shown in FIGS. 5 and 6.

The window guard 16 includes a welded framework 30 of rods 32, bars 34 and a hollow square tube 36 welded together into a unitary structure. The framework 30 is secured over the lower sash of the window 12 by a cam latching system shown in FIGS. 2–4A. This system includes a pair of brackets 38, 40 securely attached to the building exterior with impact driven screws 42 of a type which cannot be removed with the use of hand tools.

The square tube 36 has a pair of in turned sections 44, 46. Section 46 receives the projecting end 48 of a cam rod 50 which extends through the building wall 52 adjacent the window opening 54. The cam rod 50 is held axially by a pair of collars 56, 58, each secured with set screws 60.

Inside collar 58 abuts an inner bracket 62 secured to the inside of the building wall 52, while collar 56 abuts short tube 64 welded to the bracket 40.

Figure 2:
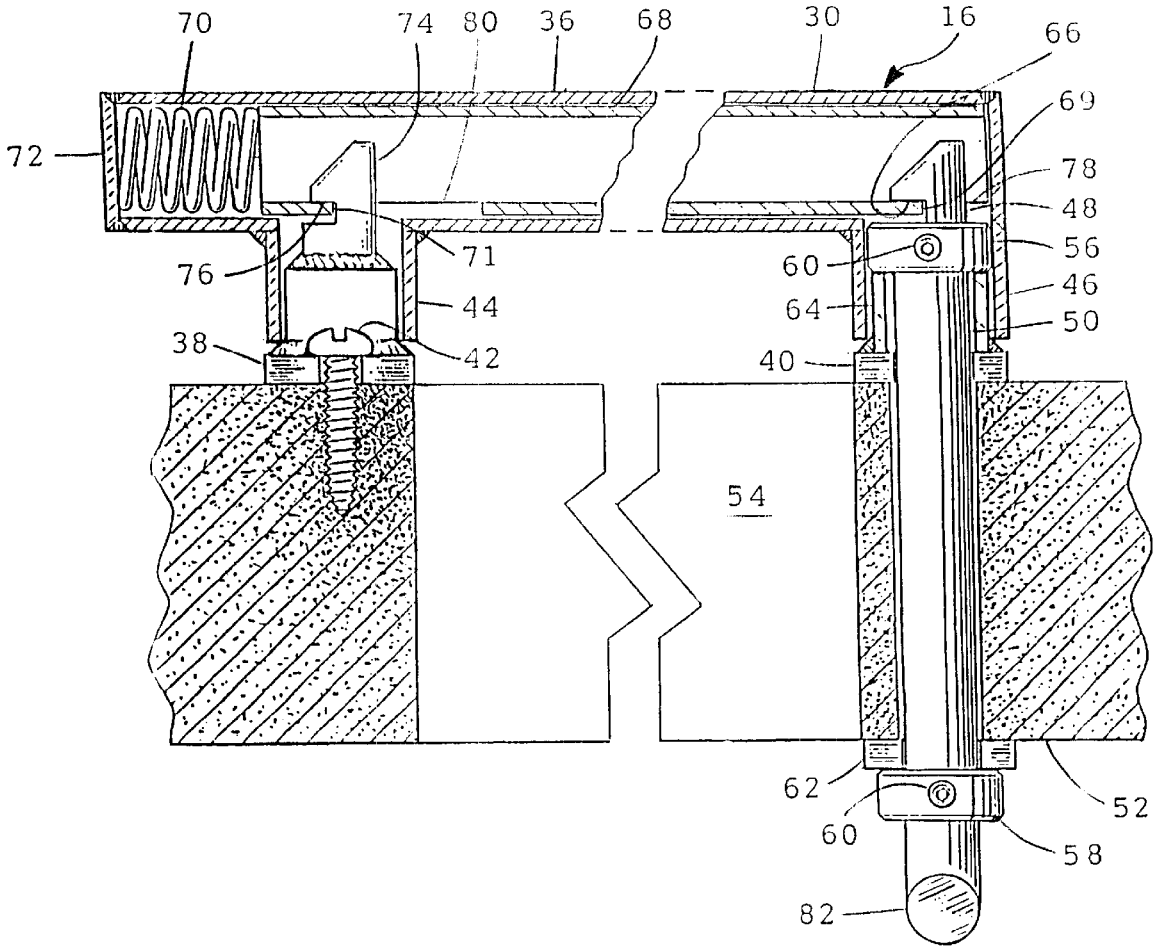
FIG. 2 is a partially sectional view of a portion of a double locked window guard and adjacent window structure, omitting certain window details for the sake of clarity, showing the latching system in a locked condition.

The cam rod end 48 has a slot 66 formed therein extending partially into one side, sized to receive one wall edge 69 of an elongated latching member here taking the form of a latching sleeve 68, slidable within the tube 36 as shown in FIG. 2. The latching sleeve 68 is urged towards cam rod 50 and slot 66 by a compression spring 70 compressed between the opposite end of the latching sleeve 68 and an end wall 72 of the framework tube 36.

A fixed latching post 74 is welded to bracket 38 extending out within the section 44, and also has a slot 76 formed partially through and facing in the same direction as slot 66 so as to receive and the edge of the wall 71 of sleeve 68. Cutouts 78 and 80 are formed in the tube 36 to allow the cam rod end 48 and fixed latching post 74 to be received into the sleeve 68 and align slots 66, 76 with exposed edges 69, 71 of the inner wall of the sleeve 68.

Figure 3A:
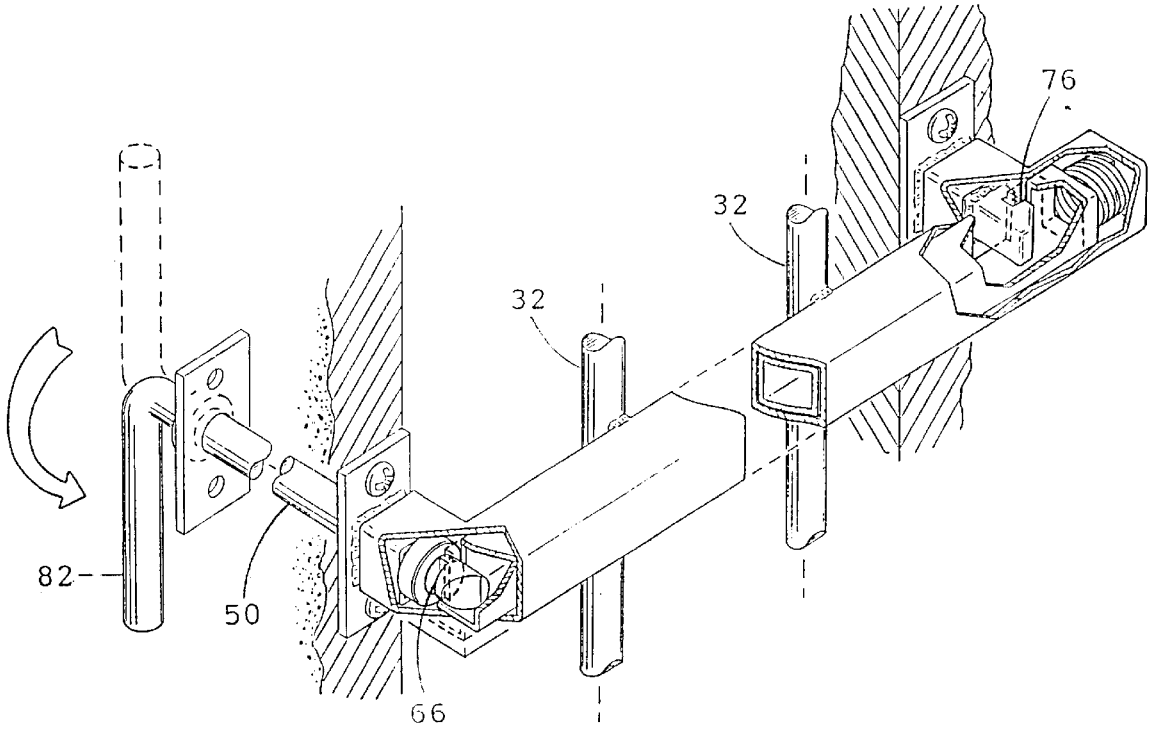
FIG. 3A is a perspective view partially broken away of the window guard portion shown in FIG. 2.

To release the framework 30, the cam rod 50 has an angled handle portion 82 allowing the cam rod 50 to be rotated 180° to a release position shown in FIGS. 3, 3A.

This causes the slot 66 to be turned in an opposite direction from slot 76, and the body of the cam rod 50 cams the slidable latching sleeve 68 to the left, with the sleeve edges 69, 71 thereby disengaged.

This unlatches the framework 30 allowing it to be pushed off the cam rod end 48 and latching pin post 74 as shown in FIGS. 4 and 6.

FIG. 4A shows a cocked position of the cam rod 50, ready for installation of the framework 30, in which the handle 82 is rotated to position the slot 66 in the same direction as slot 76.

The latching post 74 and the end 48 of cam rod 50 each have sloping surfaces 84, 86 engaging edges of openings 78, 80 in the latching sleeve 68 as the tube sections 44, 46 are pushed onto the latching post 74 and the cam rod end 48.

Figure 2A:
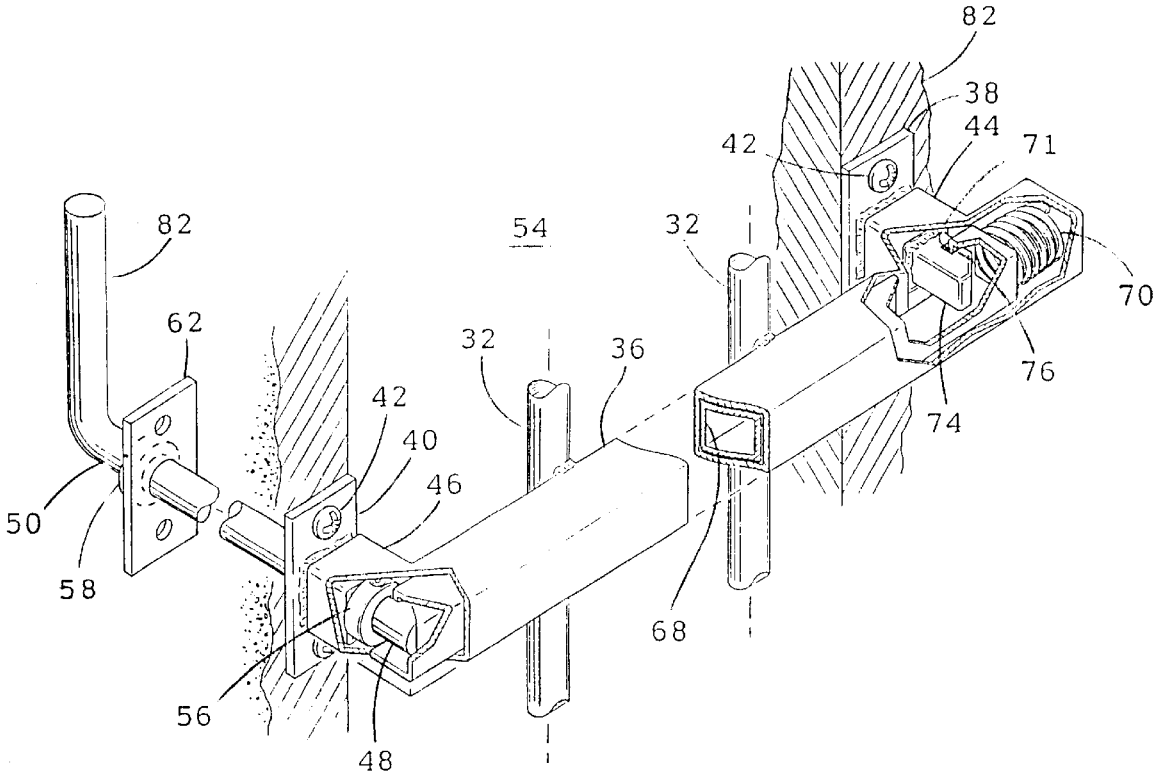
FIG. 2A is a perspective view of the window guard portion shown in FIG. 2, partially broken away.

This shifts the latching sleeve 68 to the left against the force of the spring 70, which pushes the sleeve 68 back once the slots 66, 76 become aligned to lock the framework in position as seen in FIGS. 2, 2A. Thus, installation does not require another person inside to turn the cam rod 50 after the framework 30 is pushed into position.

Figure 7:
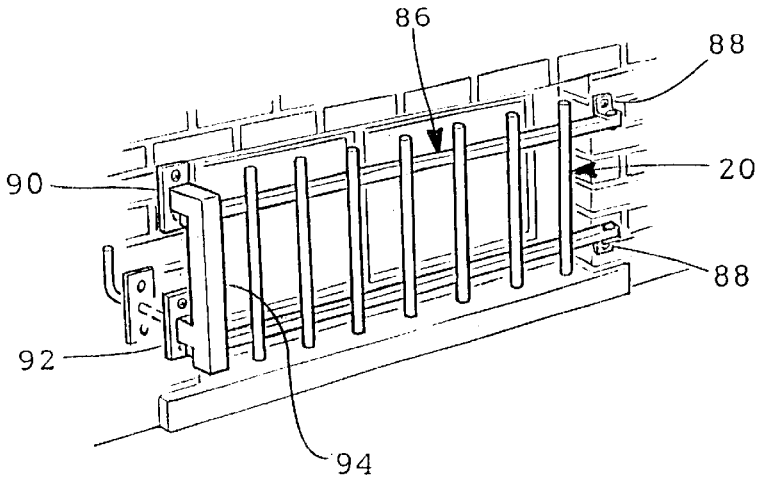
FIG. 7 is an external perspective view of a vertically double latched hinged window guard installation shown in the latched condition.
Figure 8:
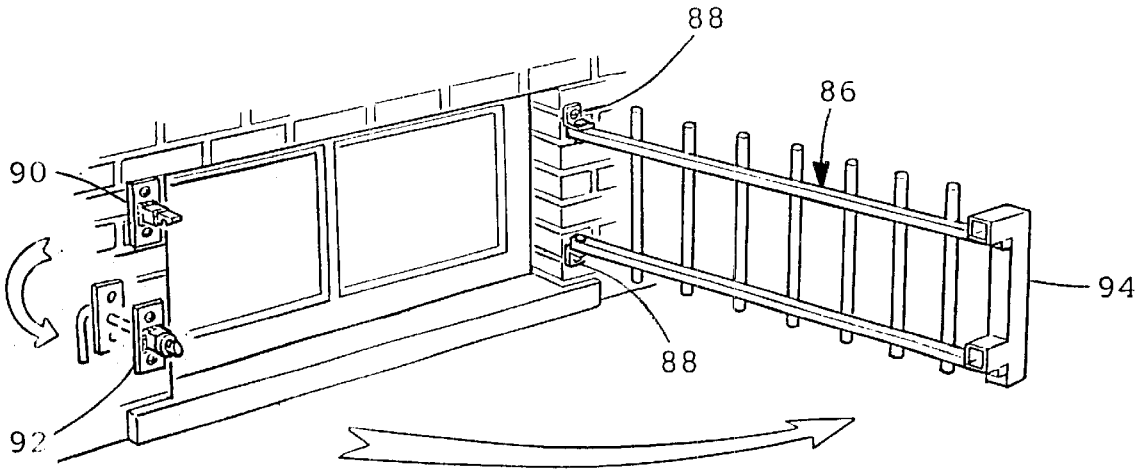
FIG. 8 is a perspective view of the window guard of FIG. 7 shown with the window guard unlatched.
Figure 9:
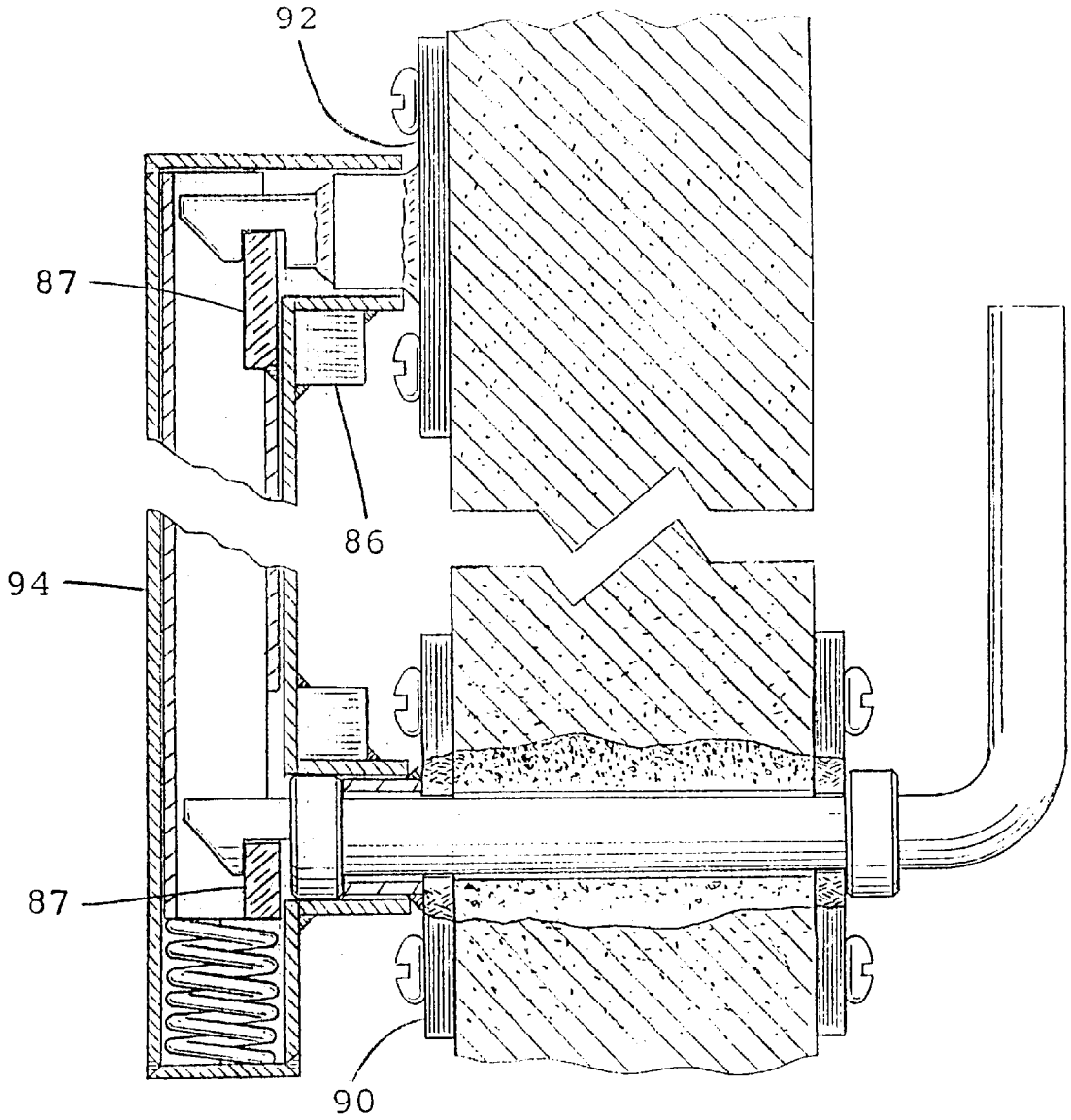
FIG. 9 is a view of a partially vertical section taken through the window guard of FIG. 7.

FIGS. 7–9 show the double locked window guard 20 which has a framework 86 hinged at 88 on one side, and double locked onto brackets 90 and 92 on the other side, using a vertically oriented latching system using a vertical square tube 94, which is otherwise similar to the system described above. However, the cam rod 50 in the case is located at the same end of the locking sleeve 68 whereas the spring 70. Heavy edge pieces 87 are welded to the sleeve 68 for defining slot engaging edges of increased strength.

Figure 10:
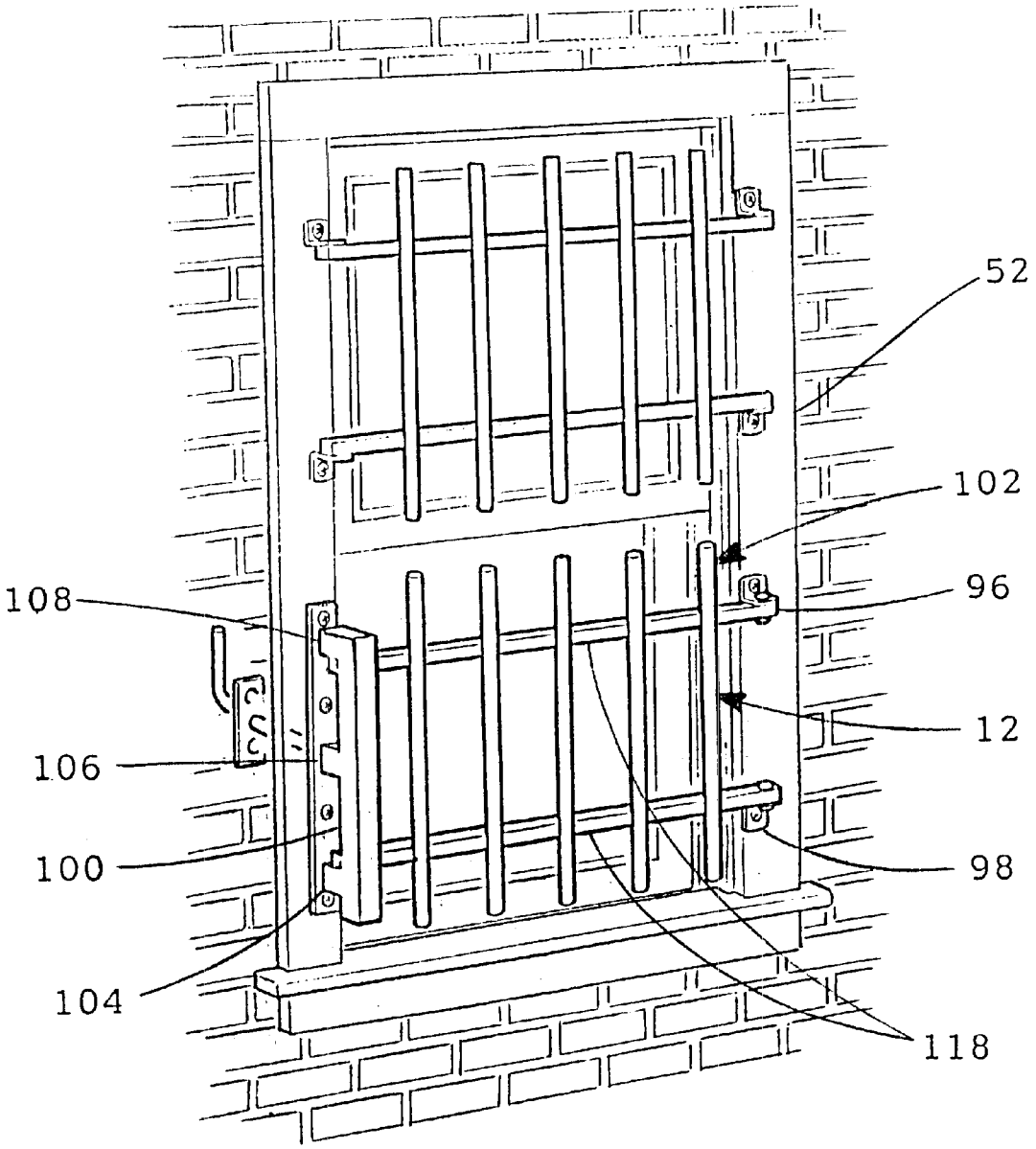
FIG. 10 is a perspective view of a triple latched window guard installation.
Figure 11:
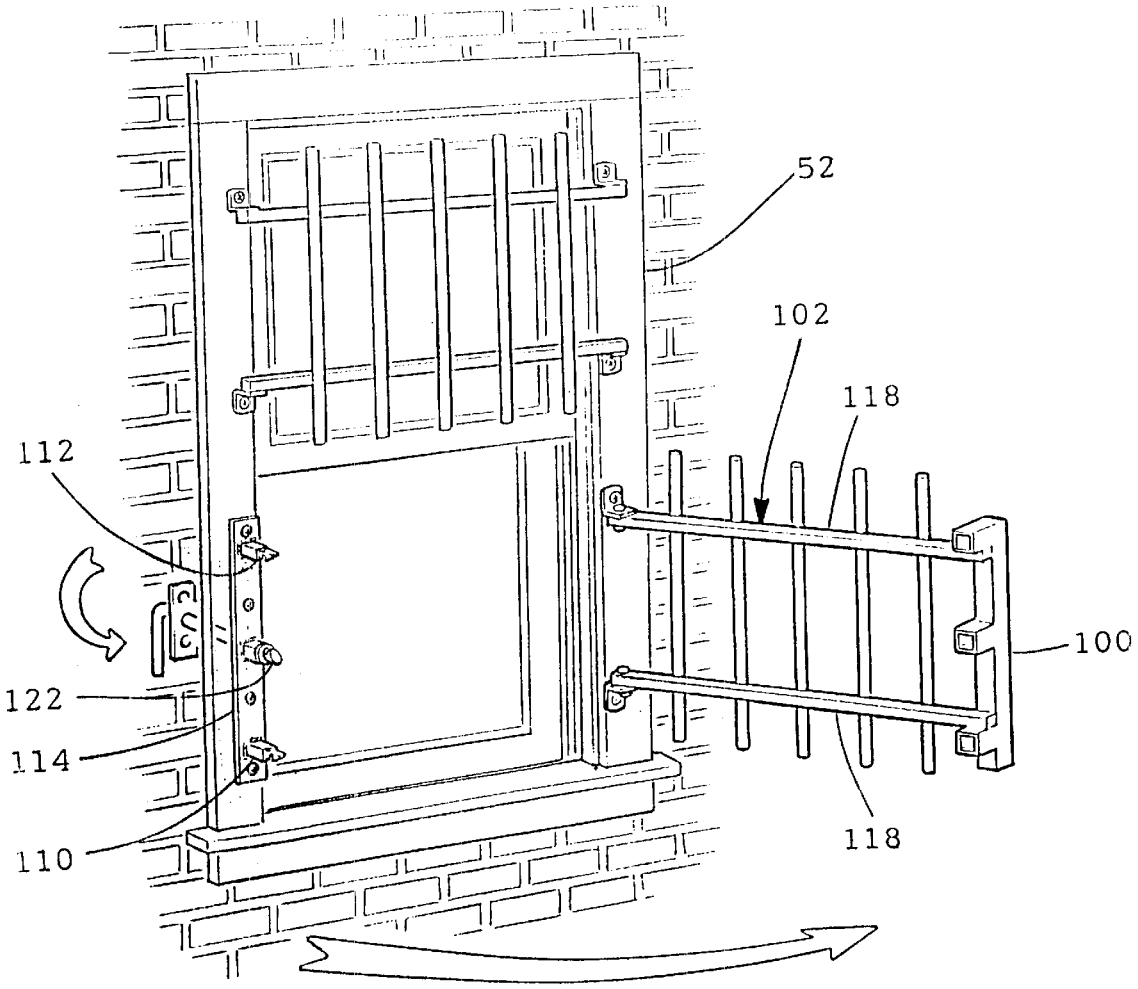
FIG. 11 shows the window guard of FIG. 10 unlatched and swung open.
Figure 12:
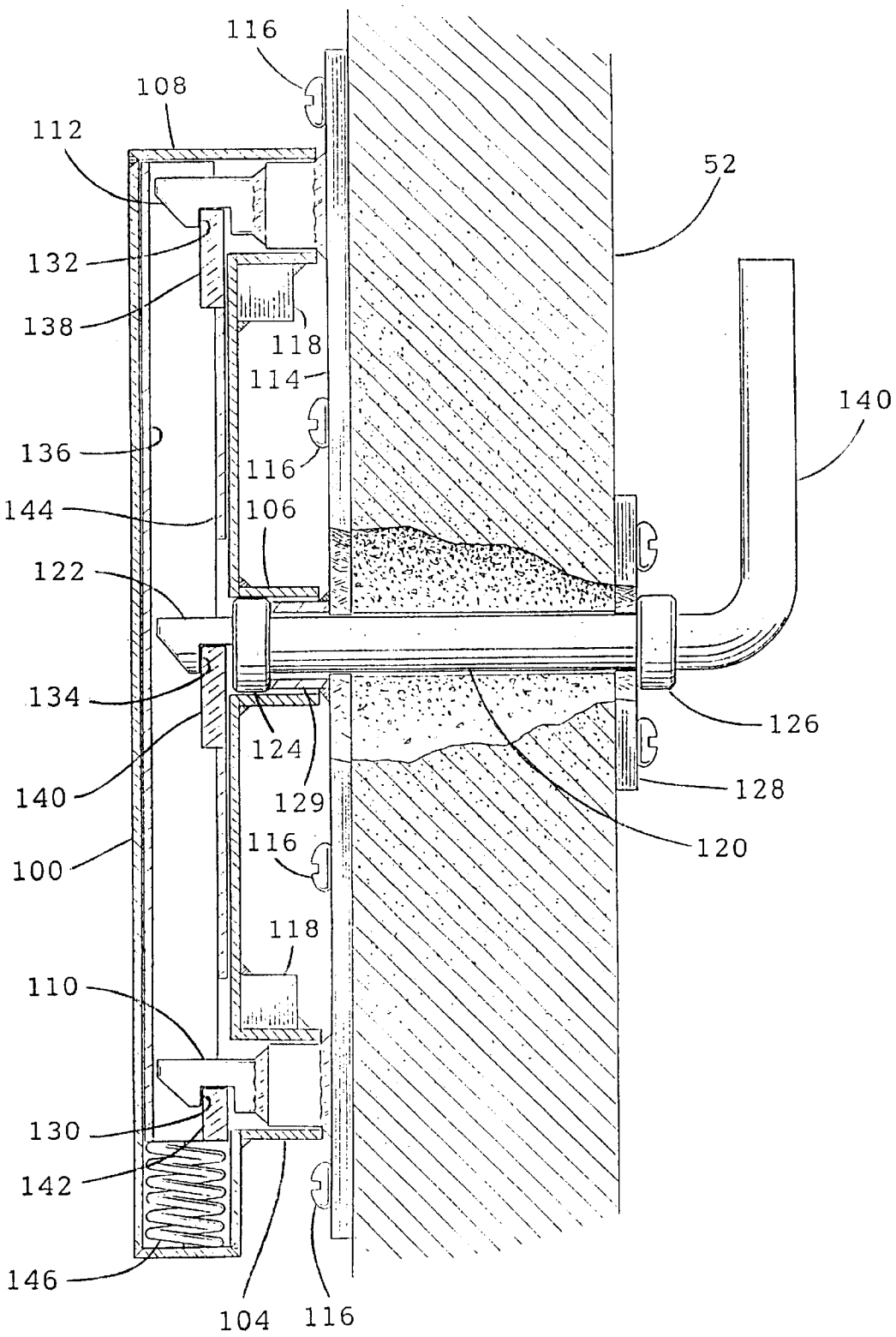
FIG. 12 is a partially sectional view of a triple latched version of the window guard latching system of the present invention as shown in FIGS. 10 and 11.

FIGS. 10–12 show a triple locked window guard 18 which is also hinged at 96, 98. A vertical square tube 100 is connected to the opposite side of a framework 102, having three inwardly extending sections 104, 106, 108.

Two fixed latching posts 110, 112 are welded to a single vertical bracket plate 114 affixed to the building exterior 52 with drive screws 116. Framework 118 is welded to the inside corners to tube sections 108, 104.

A cam rod 120 extends through a hole drilled in the building wall 52 to projecting 122 into opening in the tube section 106. The cam rod 120 is held against axial movement by two collars 124, 126 affixed to the cam rod 120 as described above, collar 126 abutting an inside bracket 128 and collar 124 abutting tube 129 welded to bracket plate 114 to axially restrain cam rod 120.

The posts 112, 110 each have aligned slots 130, 132 in one side, and cam rod end 122 also has aligned slot 134 turned in the same direction when locked. The tube 100 slidably mounts a latching sleeve 136 having heavy plates 138, 140, 142 acting as engagement edges welded in the inside wall 144 to be received in slots 132, 134, 130, respectively in the latched condition.

As before, a spring 146 acts on the latching sleeve 136 to urge the edges of the plates 138, 140, 142 into their mating slots 132, 134, 130 as shown in FIG. 12.

The cam rod 120 has a bent handle 148 allowing turning of the cam rod 120 to rotate the cam rod end 122 to force the latching sleeve 136 downward and cam plates 138, 140, 142 out of their respective slots to release the framework 102.

The framework 102 can then be swung out as shown in FIG. 11.

Figure 13:
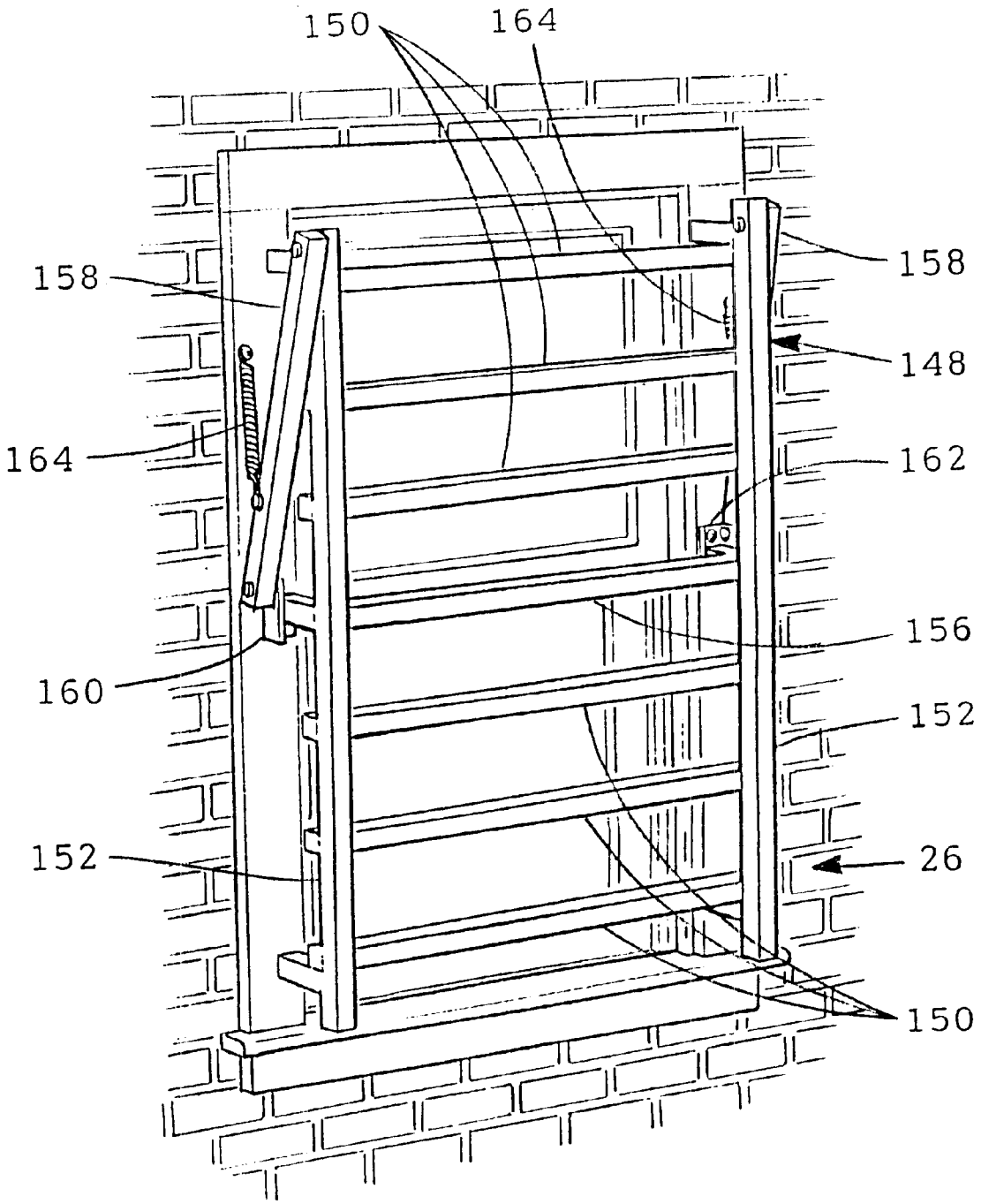
FIG. 13 is a perspective view of a window guard according to the invention convertible to a fire escape ladder.

FIG. 13 shows the window guard 26 which has a framework 148 with horizontal members 150 and vertical sides 152 forming a ladder structure.

One of the members 156 is equipped with a latching system as described above.

A pair of swing members 158 are each pivoted at one end to a respective bracket 160, 162 which together with tubes 168 form a part of the latching system, and at the other end to one end of a respective member 152. Springs 164 are provided to slow deployment lessening shock to brackets and building.

Standoff tube sections 166, 170 hold the framework away from the building exterior, allowing clearance for footing.

Figure 14:
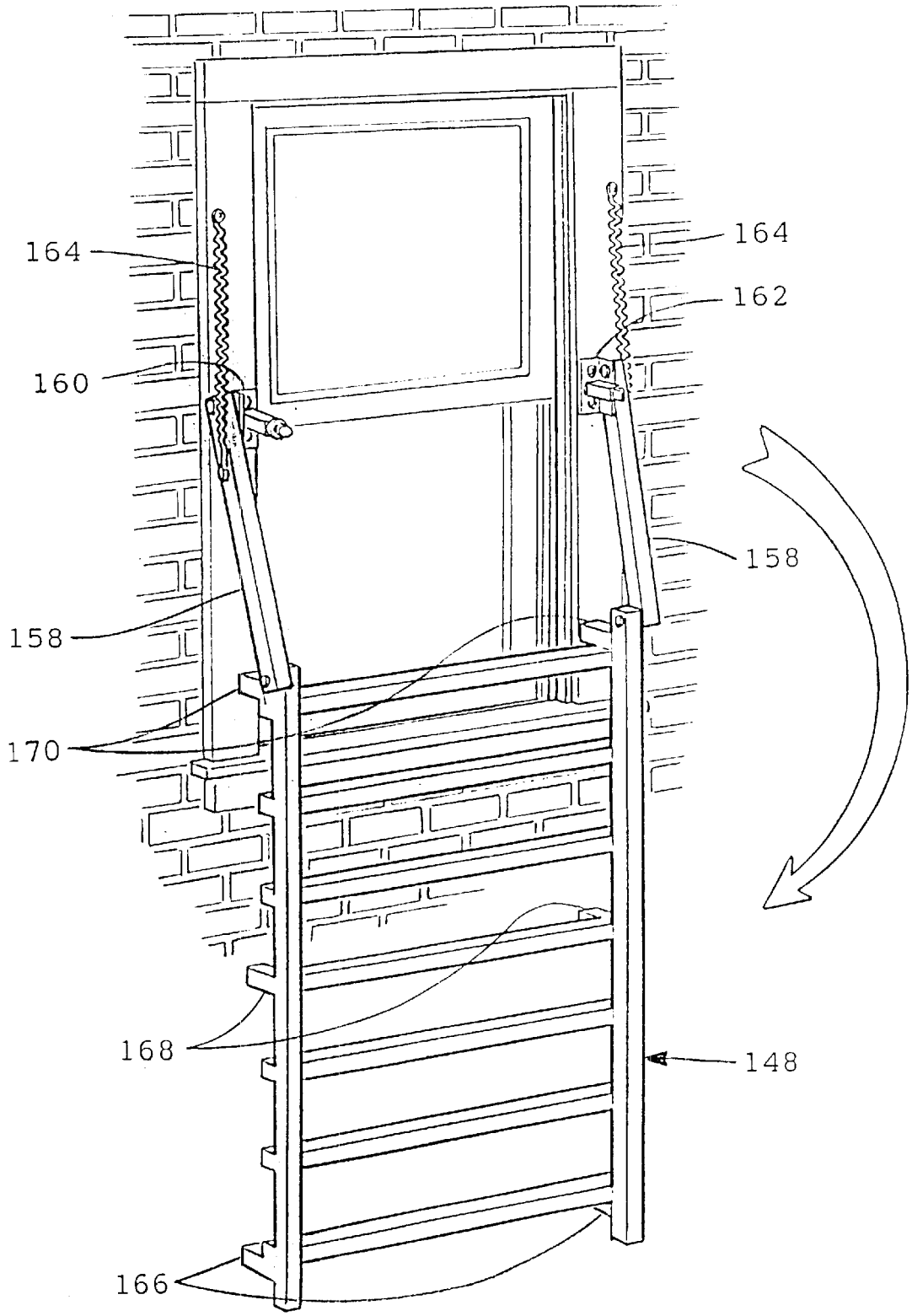
FIG. 14 is a perspective view of the window guard of FIG. 13 with the window guard unlatched and deployed as a ladder.

When the latching system is operated to release the framework 148, the framework 148 can be pushed out and will be lowered as members 158 swing down as shown in FIG. 14.

Figure 15:
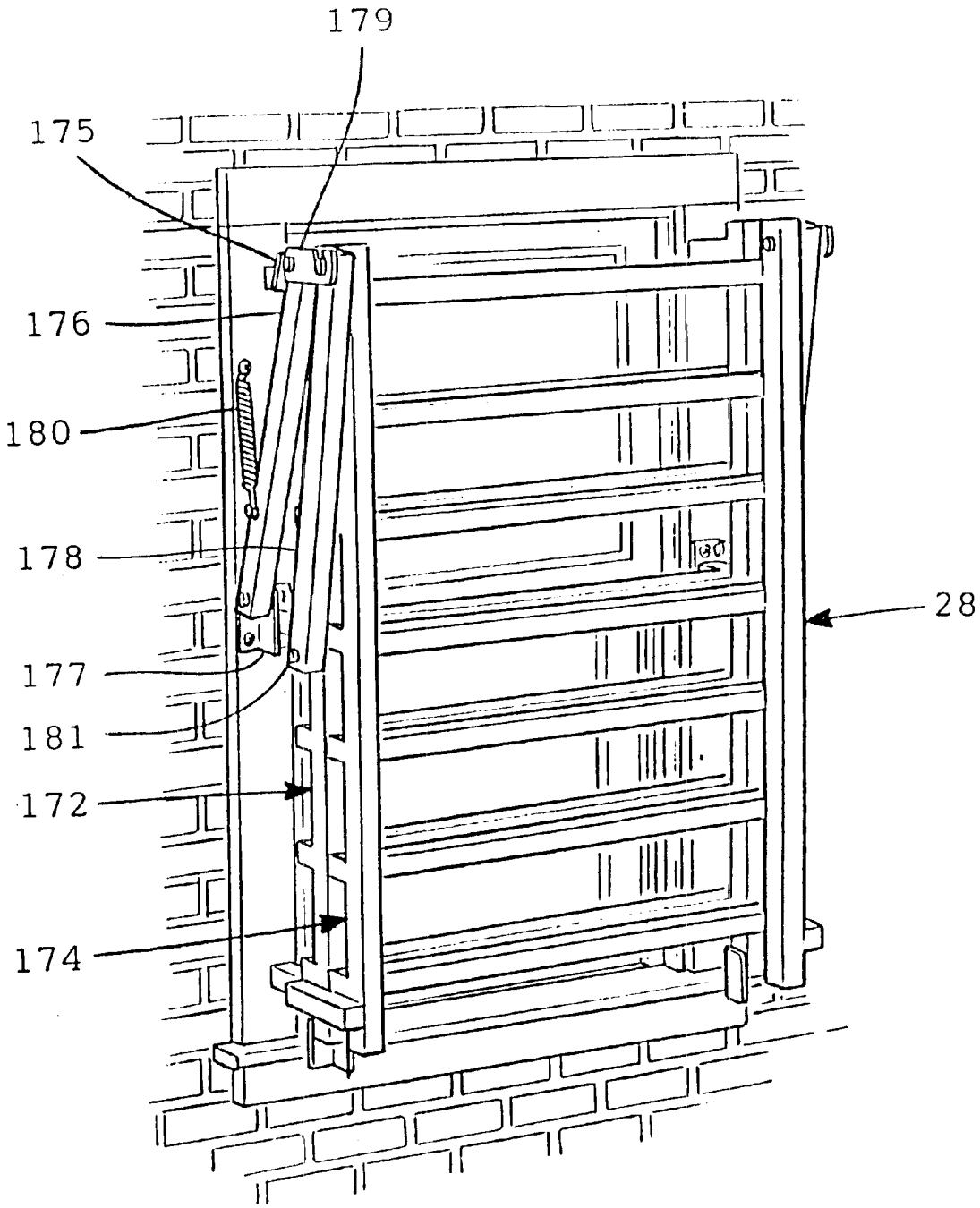
FIG. 15 is a perspective view of a double section version of the window guard shown in FIGS. 13 and 14.
Figure 16:
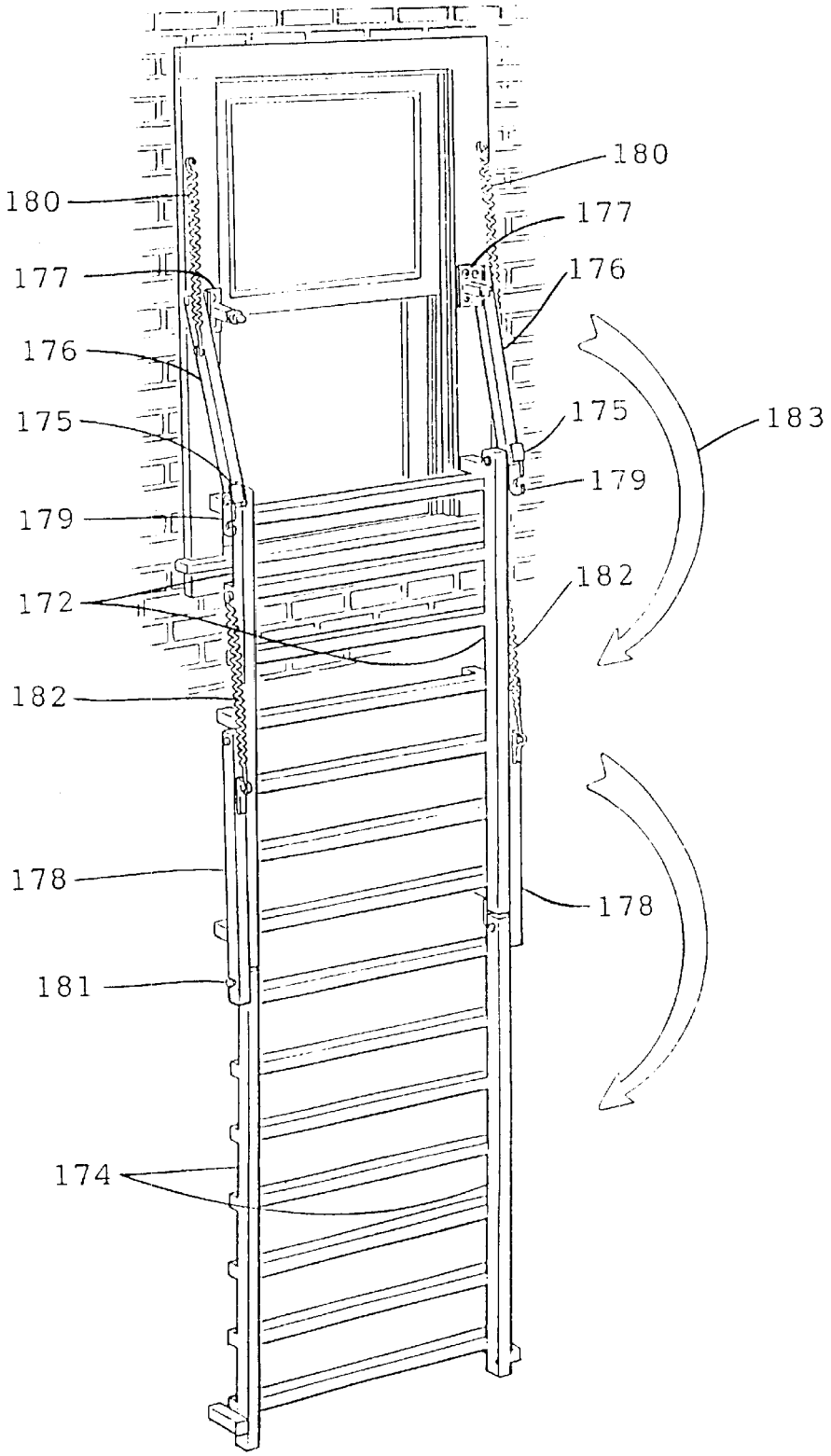
FIG. 16 is a perspective view of the ladder section of FIG. 15 deployed.

FIGS. 15 and 16 show the window guard 28 having a double section of two frameworks 172, 174 held in a stacked position with a pair of latches 179 holding the outer framework 174 on the inside framework 172. Two pairs of swing arms 176, 178 are pivoted to respective frameworks 172, 174, and corresponding sets of springs 180, 182. The frameworks 172, 174 form ladder sections, which swing down together on the first pair of swing arms 176 pivoted to brackets 177 attached to the window after the latching system releases the inside framework 172 to allow both frameworks 172, 174 to swing down in a first deployment stage indicated by arrow 103. The outer framework 174 is then released from the inside framework 172 by action of a plate 175 welded to bracket 176 forcing off latches 179 from the heads of pivot pins 181. The second set of swing arms 178 are pivoted at one end to the middle of inside framework 172 and at the other to the upper end of the outer framework 174. Release of the latch 179 from pivot pins 181 causes the frameworks 172, 174 to extend end to end in a second deployment stage as shown in FIG. 16.

Figure 17:
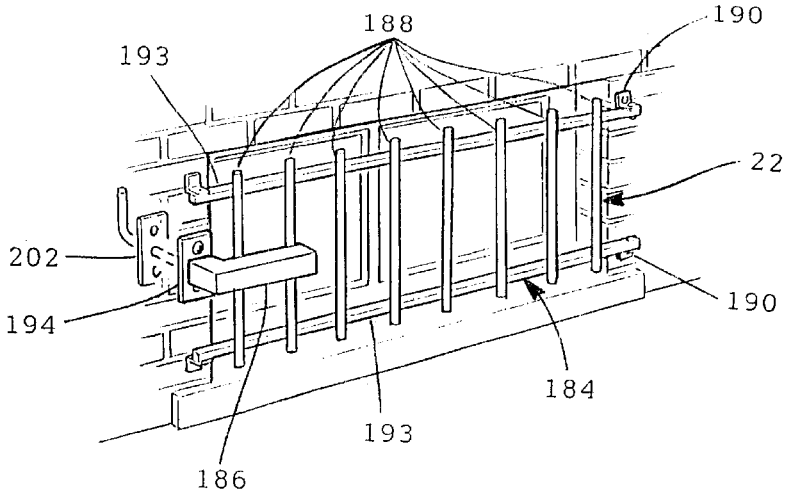
FIG. 17 is a perspective view of another embodiment of the single latch version of the window guard according to the invention.
Figure 18:
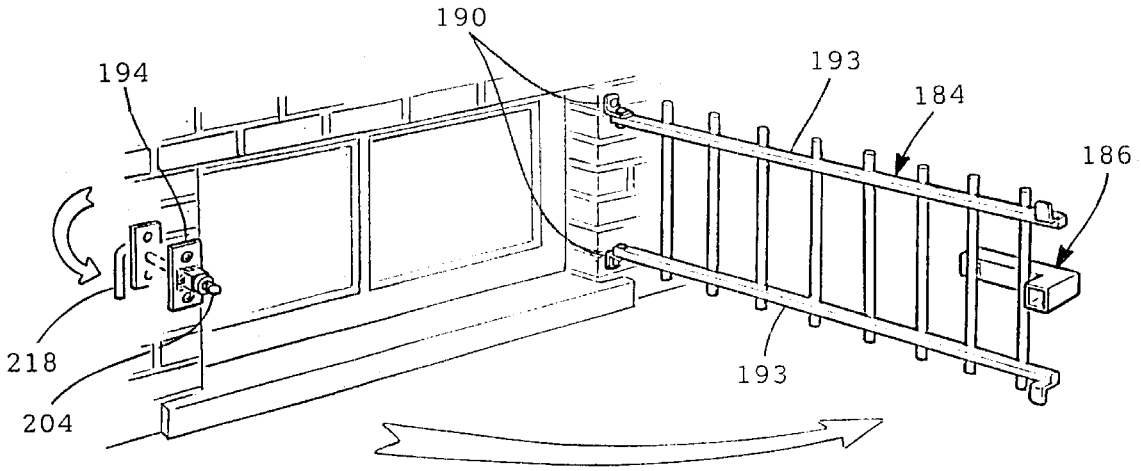
FIG. 18 is a perspective view of the single latch embodiment shown in FIG. 17.
Figure 19:
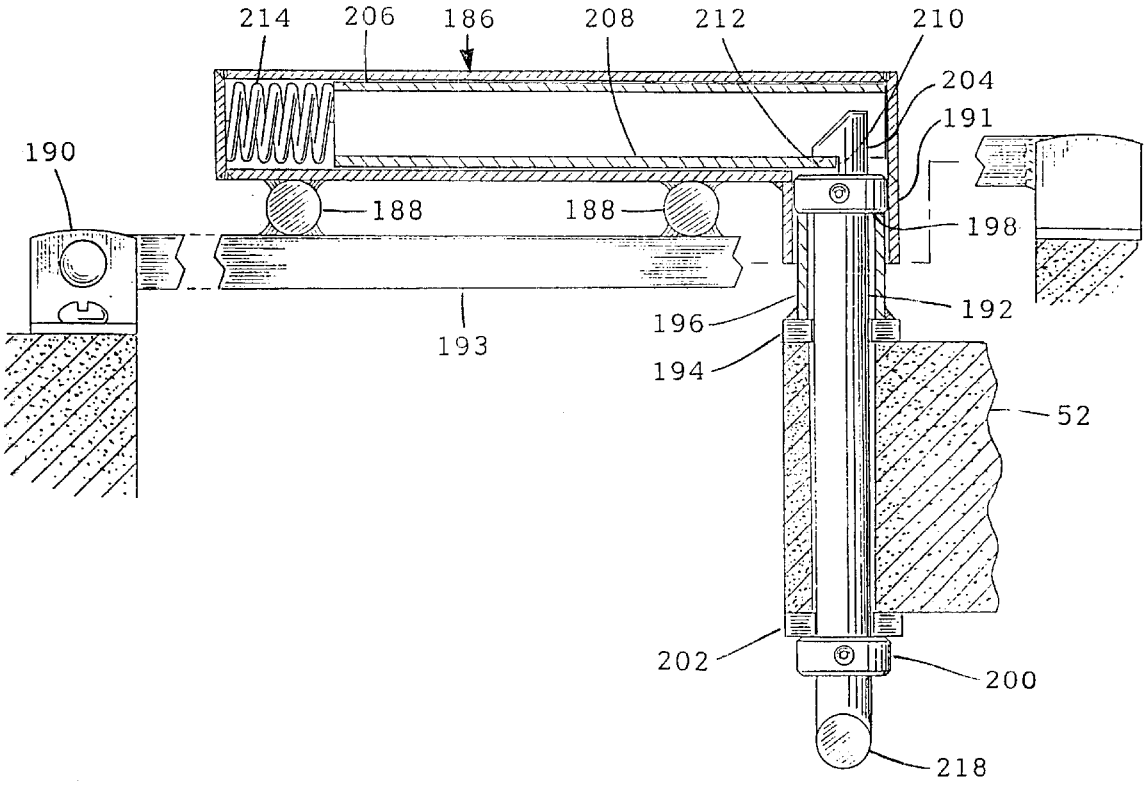
FIG. 19 is a partially sectional view of the latching system of the embodiment shown in FIGS. 17 and 18.

FIGS. 17–19 show single lock window guard 22, which includes a framework 184 hinged at 190 to the building exterior on one side. A short square tube 186 is welded to two of the vertical rods 188 of the framework 184 (FIGS. 17 and 18), having an inturned section 191. Rods 188 are welded to two horizontal square rods 193 mounting the hinges 190.

In turned section 190 receives a cam rod 192 extending through the wall 52.

A bracket 194 has a short tube section 196 welded thereto, which abuts collar 198 fixed to cam rod 192. Inside collar 200 abuts an inside bracket 202.

The outside end 204 of cam rod 192 protrudes through the square tube 186 and into a latching sleeve 206 slidable in tube 186. The inner wall 208 is notched out to form an edge 210 urged into a slot 212 extending partially into the cam rod end 204 by a spring 214. This latches the unhinged side of the framework 184.

Unlatching and release is accomplished by rotating the cam rod 192 using angled end handle 218. The allows the framework to be swung out on hinges 190 as shown in FIG. 17.

The vertical rods 32 can be eliminated for shallow height windows, as with the framework 24 shown in FIGS. 1, 2, 3, 4 and 4A.

What is claimed is:

1. A window guard installation in combination with a building and a building window, comprising:

a window guard framework adapted to be positioned against an exterior of said building adjacent said window so as to extend over said window, to be held in place at least in part by a cam-latch system, said cam-latch system including:

an elongated cam-latch element extending through a wall of said building to have an end protruding through said exterior thereof adjacent said window, said cam-latch element secured against axial movement but able to be manually rotated;

said protruding end of said cam-latch element inserted into an opening in an elongated hollow shielding member extending transversely to said cam-latch element and forming a part of said window guard framework when said window guard framework is position over said window;

a camming engagement portion and a latching portion on said protruding end of said cam-latch element;

a latching member slidable within said hollow member, a spring urging said latching member towards said cam-latch element protruding end, said latching member having a portion aligned with said camming engagement portion so as to be able to be moved by said spring into latching engagement with said latching portion when said cam-latch element is rotated to a position whereat said camming engagement portion is facing said latching member portion, said latching member latched to said cam-latch element protruding end by engagement with said latching portion when said window guard framework is pushed onto said cam-latch element protruding end in being positioned over said window, said latching member latched to said cam-latch element with said latching portion thereof in engagement with said camming engagement latching portion, and said latching member pushed to be slid back against the force of said spring by said camming engagement portion upon rotation of said cam-latch element forcing said latching member portion out of engagement with said cam-latch element latching portion to release said window guard framework;

a fixed latching post mounted to said building exterior at a location spaced transversely from said elongated cam-latch element, and having an end protruding into another opening in said hollow member when said window guard framework is positioned over said window, said latching post having a latching engagement portion on one side facing away from said cam-latch element and aligned with another portion of said latching member, said latching member extending transversely from said cam-latch element over to said fixed latching element to be positioned to receive said another portion thereof to be latched thereto when said first mentioned portion thereof is in engagement with said latching engagement portion on said cam-latching element protruding end, and both latching member portions simultaneously forced out of engagement with said cam-latching element latching engagement portion and said latching engagement portion on said latching post against the force of said spring by said camming engagement portion when said cam-latch element is rotated.

2. The combination according to claim 1 wherein said cam-latch element protruding end is on one of side of said window guard framework and said fixed latching post is on another side, when said window guard framework is held against said building exterior by engagement of said latching member portions with said latching post latching engagement portion and said latching engagement portion on said cam-latch element.

3. The combination according to claim 1 wherein said cam-latch element comprises a rod having a handle on one end disposed within said building structure.

4. The combination according to claim 3 wherein said cam-latching element latching engagement feature comprises a transverse slot extending into one side of said protruding end thereof and a perimeter surface of said cam-latching element at said slot comprises said camming engagement feature thereof.

5. The combination according to claim 1 wherein said latching member comprises a sleeve slidable in said hollow member, both said hollow member and sleeve comprised of square tubes.

6. The combination according to claim 1 wherein said hollow member has an in-turned portion enclosing said cam-latch element protruding end.

7. The combination according to claim 1 wherein said hollow member has a pair of in-turned hollow portions, one receiving said cam-latch element protruding end, the other receiving said latching post when said window guard framework is positioned over said window.

8. The combination according to claim 1 wherein each of said cam-latch element end and said latching post have sloping ends engaging said latching member respective portions when said hollow member is pushed against said cam-latch element protruding end and said latching post to slide said latching member away therefrom against the force of said spring.

9. The combination according to claim 1 wherein said framework is formed as a ladder section, said window guard framework having a top mounted to said building exterior with a pair of pivoted arms so as to drop and hang down below said window when said cam latch system releases said framework.

10. The combination according to claim 9 wherein said framework further includes a ladder section stacked over said window guard framework, said ladder section connected by a pair of pivoting swing arms to said window guard framework to hang below said window guard framework when said window guard framework is pushed free after release by said cam latch system.

11. The combination according to claim 1 further including a second latching post fixed to said building exterior at a location spaced laterally from both said first mentioned latching post and said cam-latch clement, and having a latching engagement portion, said second latching post located on the other side of said cam-latch element protruding end from said first latching post, said second latching post inserted into another opening in said hollow member with said window guard framework positioned over said window, said latching engagement portion formed in one side thereof facing said first mentioned latching post, said latching member having a portion aligned therewith to engage said latching engagement portion of said second latching post when said cam-latch element protruding end is rotated to a latching position.

12. A window guard installation in combination with a building and a building window, comprising:

a window guard framework configured to cover said window and held in place by a cam-latch system including an elongated cam-latch element extending through a wall of said building to be received into a hollow member of said window guard framework;

a latching member slidable within said hollow member, and extending transversely at least partially across said window;

a spring urging said latching member towards said cam-latch element;

a cam element and a latching element associated with said cam-latch element, said latching member urged into engagement with latching element by said spring to prevent outward movement of said window guard, said cam element sliding said latching member out of engagement with said latching element against the force of said spring upon rotation of said cam-latch element;

a fixed latching element spaced transversely from said cam latch element received in said hollow member, said hollow member and latching member extending to said fixed latching element, said latching member urged into engagement with said fixed latching element by said spring, said latching member slid out of engagement therewith by said rotation of said cam-latch element so that window guard is thereby simultaneously released from both of said latching elements.

* * * * *